US005941235A

United States Patent [19]

Carter

[11] Patent Number: 5,941,235

[45] Date of Patent: Aug. 24, 1999

[54] EXHAUST UNIT WITH VENTLESS HOOD

[75] Inventor: Thomas E. Carter, Maplewood, N.J.

[73] Assignee: Garland Commercial Ranges Limited, Toronto, Canada

[21] Appl. No.: 08/510,778

[22] Filed: Aug. 3, 1995

[51] Int. Cl.[6] ..... F24C 15/20

[52] U.S. Cl. ..... 126/299 R; 126/299 D; 55/DIG. 36

[58] Field of Search ..... 126/299 R, 299 D, 126/300, 301, 21 R; 55/DIG. 36

[56] References Cited

U.S. PATENT DOCUMENTS

| | | | |
|---|---|---|---|
| 3,391,689 | 7/1968 | Roger | 126/299 R |
| 3,691,931 | 9/1972 | Persson | 126/299 D |
| 3,954,427 | 5/1976 | Jenn | 126/299 D |
| 4,034,663 | 7/1977 | Jenn et al. | 126/299 D |
| 4,612,909 | 9/1986 | Lee | 126/299 D |
| 5,002,040 | 3/1991 | MacFarlane | 126/299 D |
| 5,125,328 | 6/1992 | Grandi | 126/299 D |

*Primary Examiner*—James C. Yeung
*Attorney, Agent, or Firm*—Borden & Elliot

[57] ABSTRACT

An exhaust unit for filtering air from an exhaust hood above cooking equipment comprising modular components including an exhaust hood, filtering means and blower means operating as a single unit regardless of configuration.

19 Claims, 9 Drawing Sheets

EXHAUST UNIT WITH VENTLESS HOOD

FIELD OF THE INVENTION

This invention relates to an exhaust unit for filtering exhaust air from exhaust hoods, and particularly relates to a housing which is selectively connected to the exhaust hood in a plurality of configurations. In one embodiment, the exhaust unit assembly includes a housing, an air wall enclosure, and an exhaust hood where the housing may be directly connected to the exhaust hood and air wall enclosure, or remotely connected thereto by means of an air duct system.

BACKGROUND TO THE INVENTION

There have been a variety of exhaust units designed and manufactured for filtering exhaust air from cooking apparatus and discharging the filtered exhaust air out of the unit. These exhaust units may be fixed or portable, and have been manufactured for exhausting the exhaust fumes discharged by cooking apparatus which utilize natural gas or electricity to produce the desired heat.

Such exhaust units have either utilized air ducts which direct the exhaust fumes outside of the building, or have directed the exhaust fumes through a filtering system and recirculated the filtered exhaust fumes back into the existing building.

For example, U.S. Pat. No. 5,154,161 teaches an air filter provided for food cooking apparatus to avoid the necessity for venting within the building, and permitting the use of free-standing, independently moveable structures capable of receiving a moveable cooking apparatus.

In addition, U.S. Pat. No. 5,133,786 teaches a method and apparatus for cooking foods which method includes the steps of directing an air sheet across the top of the cooking machine. Other arrangements are shown in U.S. Pat. No. 5,002,040 which relates to a moveable, self-contained exhaust unit for filtering exhaust air for cooking apparatus.

Furthermore, U.S. Pat. No. 3,889,581 illustrates a duct system for conducting grease containing vapours from a cooking stove.

Also, U.S. Pat. No. 3,954,427 discloses a free standing cooking fume and odour collecting or ventilating unit which is adapted to be positioned adjacent a cooking surface.

However, as cooking appliances and facilities, particularly those used in the fast food industry, are being introduced into hospitals, stadiums, office buildings, and shopping plazas, the ventilation of exhaust fumes discharged from such equipment is becoming a critical factor when investigating the feasibility of potential site locations. For example, multi-storey structures sometimes require expensive duct work and fire-rated shafts while existing buildings may not have roof-top exhaust capabilities. Also, the installation of traditional venting equipment in a multi-storey building is time-consuming and costly. Indeed, institutional sites, such as hospitals, usually may not provide adequate ventilation or roof top access and construction design suitable for installation of exhaust equipment. Moreover, historical sites often do not allow the installation of exterior exhaust equipment. Furthermore, in other locations, multi-restaurant applications may require a single source exhaust and create numerous balancing problems.

In addition, national, regional, and local building codes are becoming more stringent, while environmental standards are being up-graded to require clean exhaust air.

Moreover, there has been an increased desire to provide cooking facility sites in kiosks in shopping plazas or the like.

Accordingly the ventilation of exhaust fumes also becomes an important consideration in such facilities.

In certain sites the cooking equipment, as well as the ventilation equipment, must be located within buildings which may only have three foot access doors, thereby creating difficulties for introducing such equipment into the available space.

Accordingly, it is an object of this invention to provide an improved exhaust unit which is versatile in application. More particularly it is an object of this invention to provide an exhaust unit which has a modular design that is easily transportable, and easily assembled to operate as a single unit in a variety of configurations for a variety of applications.

An aspect of this invention relates to an exhaust unit for filtering air from an exhaust hood above cooking equipment comprising modular components including an exhaust hood, filtering means and blower means operating as a single unit regardless of configuration.

Another aspect of this invention relates to an exhaust unit for filtering air from an exhaust hood above cooking apparatus comprising: a housing having a passage therethrough with an air inlet and an air outlet communicating with said passage; removable filter means disposed with such passage for filtering said air; blower means associated with said passage for drawing said air through said inlet and said passage, and discharging said air out said air outlet; where said housing is selectively connected to said exhaust hood in a variety of configurations.

Another aspect of this invention relates to an exhaust unit assembly for filtering exhaust air from electrical cooking equipment comprising: a housing having spaced top and bottom walls, vertically upstanding spaced front and back walls, and vertically upstanding spaced left and right hand walls defining said housing; a passage through said housing; an air inlet and an air outlet presented by said housing for communication with said passage; removable filter means disposed within said passage for filtering said exhaust air; blower means associated with said passage for drawing said exhaust air through said inlet and said passage, and out said air outlet; a vertically upstanding air wall enclosure communicating with said housing; an exhaust hood above said cooking equipment, said exhaust hood connected to said air wall enclosure and communicating with said air inlet of said housing for drawing exhaust air from said hood through said inlet of said housing through said passage for discharge through said air outlet, where said exhaust hood and said air wall enclosure are selectively connected to said housing in a plurality of configurations.

DESCRIPTION OF THE INVENTION

Figure 2:
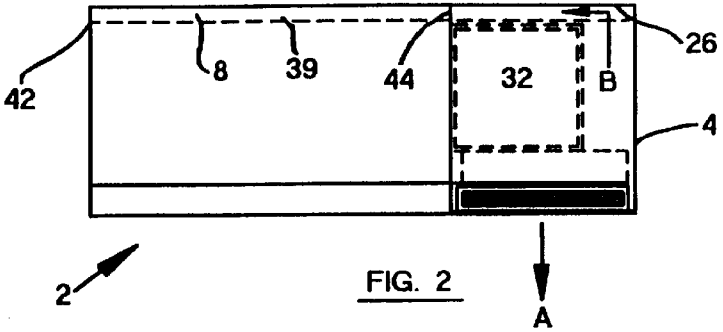
FIG. 2 is a top plan view of the exhaust unit assembly of FIG. 1.
Figure 3:
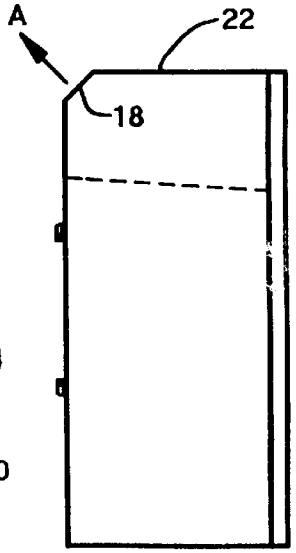
FIG. 3 is a right-hand side elevational view of FIG. 1.

Like parts have been given like numbers throughout the Figures.

FIGS. 1 to 7, inclusive, illustrate the invention whereby the exhaust unit assembly 2 includes an exhaust unit or pod 4, hood 6 and air wall means or air wall enclosure 8. The exhaust unit or pod 4 includes an air inlet 10, a filter means 12, blower 14, and blower motor 16. Furthermore, the exhaust unit also includes an air outlet 18 to the environment.

Figure 7:
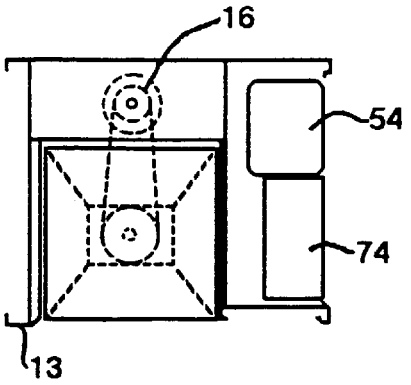
FIG. 7 is a top view of the exhaust unit with the top panel removed.
Figure 5:
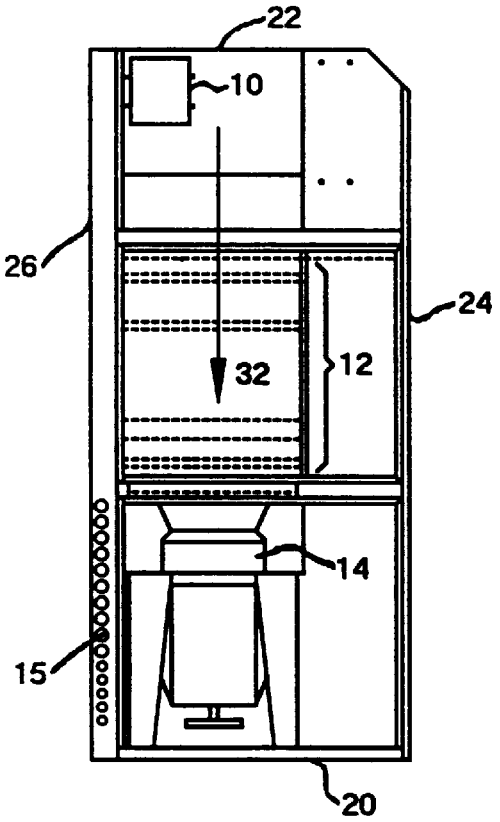
FIG. 5 is a left side view of the exhaust unit with the left side panel removed.
Figure 6:
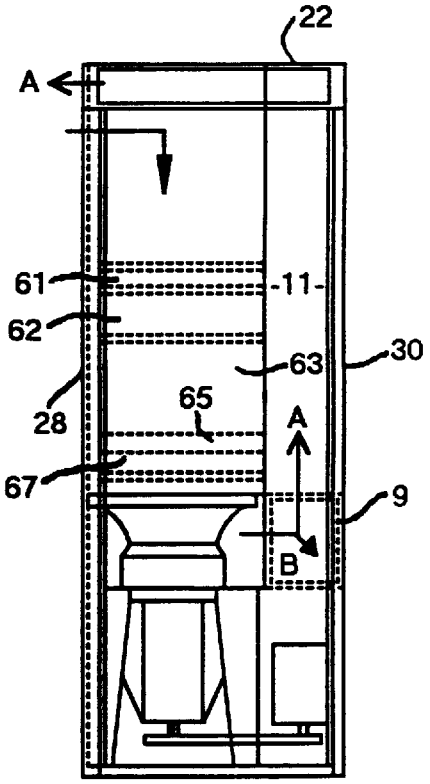
FIG. 6 is a front side view of the exhaust unit with the front panel removed.

The exhaust unit 4 is defined by a housing having a spaced bottom wall 20 and top wall 22, vertically upstanding spaced front wall 24 and back wall 26 and vertically, upstanding spaced left side wall 28 and right side wall 30, as best illustrated in FIGS. 5 to 7.

The housing may have a variety of configurations, such as being rectangular in shape, or may include protrusions and the like which are designed to follow the contour of the hood.

Figure 1:
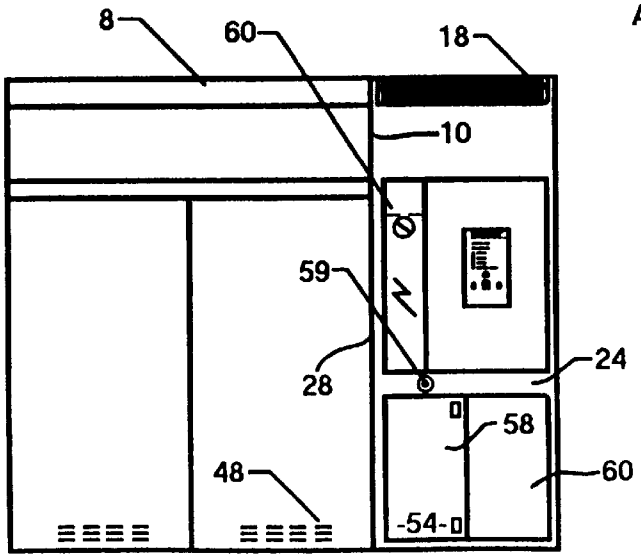
FIG. 1 is a front elevational view of the exhaust unit assembly.
Figure 10:
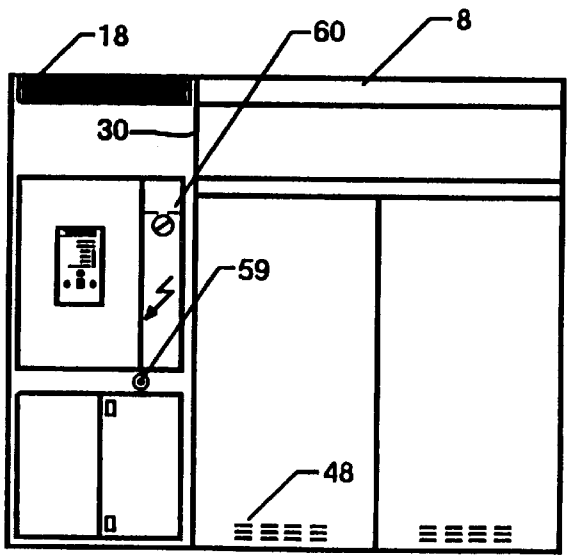
FIG. 10 is front elevational view of the second embodiment of the invention.
Figure 13:
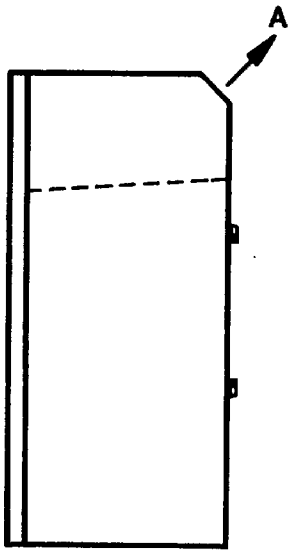
FIG. 13 is a left-hand side elevational view of FIG. 10.
Figure 15:
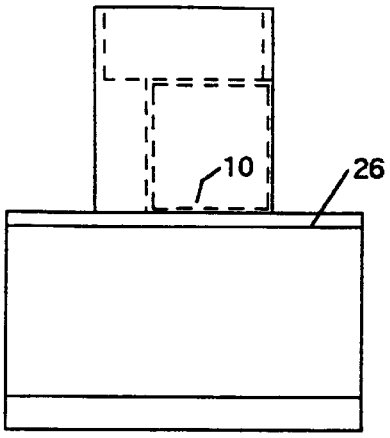
FIG. 15 is a top plan view of FIG. 14.
Figure 16:
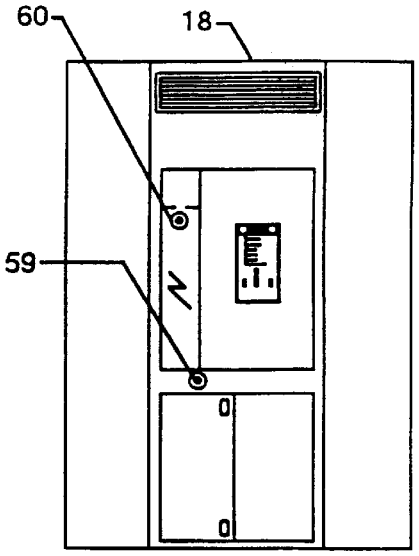
FIG. 16 is a back view of FIG. 14.
Figure 14:
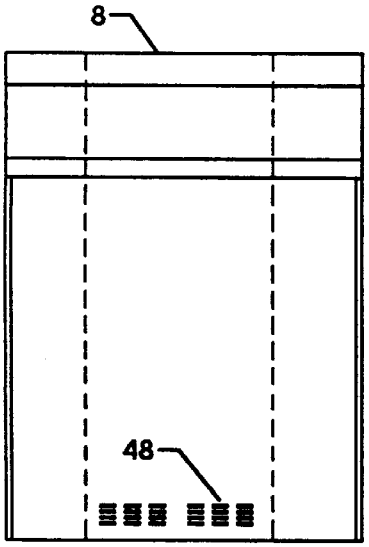
FIG. 14 is a front elevational view of a third embodiment of the invention.
Figure 17:
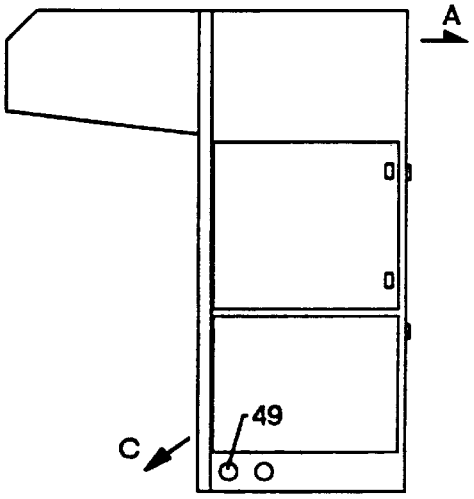
FIG. 17 is a right-hand side elevational view of FIG. 14.
Figure 18:
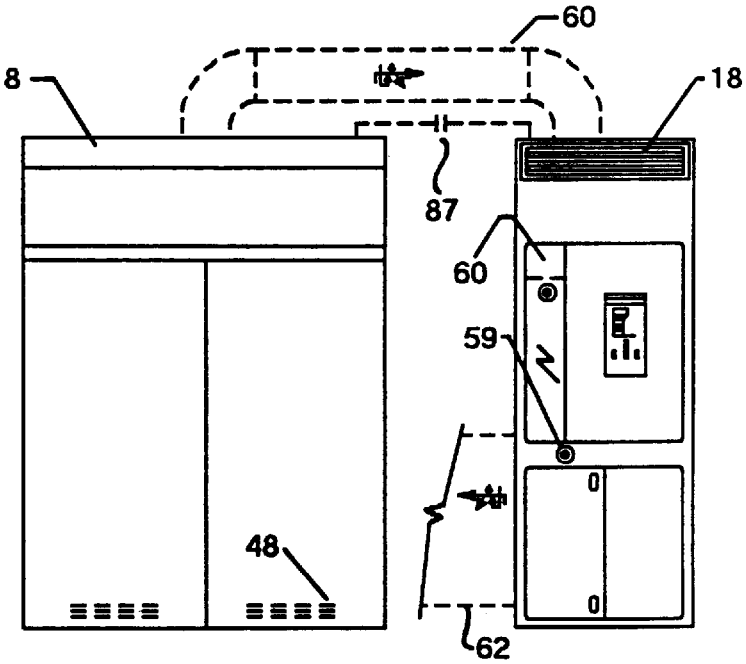
FIG. 18 is a front elevational view of another embodiment of the invention, where the exhaust unit is remotely connected to the air wall enclosure and exhaust hood.

The air inlet 10 as shown in FIGS. 1 and 5 is located along wall 28, however the air inlet may be located along a back wall 26, as shown in FIG. 15, or right wall 30 as, shown in FIG. 10, or top wall as shown in FIG. 18, depending on configuration selected by the user.

More particularly, the exhaust unit assembly 2 shown in FIGS. 1–4 comprises an assembly of the housing or exhaust unit 4, air wall enclosure 8 and hood 6. The exhaust unit assembly 2 shown in FIGS. 1–4 may be transported in three modules, namely the housing or exhaust unit 2, the air wall enclosure 8, and the hood 6. Moreover, the exhaust unit 4 is adapted such that it may be connected to existing standard exhaust hoods used in the trade.

The exhaust unit 4 is selected to be connected to the hood 6 in a plurality of configurations. In the configuration shown in FIGS. 1–7, the housing 4 is directly connected to the hood and is connected at the left side wall 28.

However, the exhaust unit 4 is versatile, such that the exhaust hood 6 may also be selectively connected to the right wall 30 of the housing 2. In this event, the air inlet 10 would be located on the upper part of right wall 30.

Moreover, the hood 6 may also be connected to the back wall 26 of housing 4 as shown in FIG. 15.

The unit 4 includes a passage 32 which communicates with the air inlet 10 and air outlet 18. The passage 32 permits air to be drawn from air inlet 10 through the filter means 12 when the motor 16 is activated so as to cause the blower to draw the exhaust fumes directed by the hood 6 into the air inlet 10 and through the passage 32.

The blower or fan 14 directs the filtered exhaust air through the air outlet 18 as shown by arrow A. The exhaust unit 4 is versatile such that all of the filtered exhaust air may be directed out of the air outlet 18 directly into the atmosphere of the room or alternatively, the filtered exhaust air may be connected to duct work so as to direct all of the air outside of the building as shall be shown hereinafter.

Figure 8:
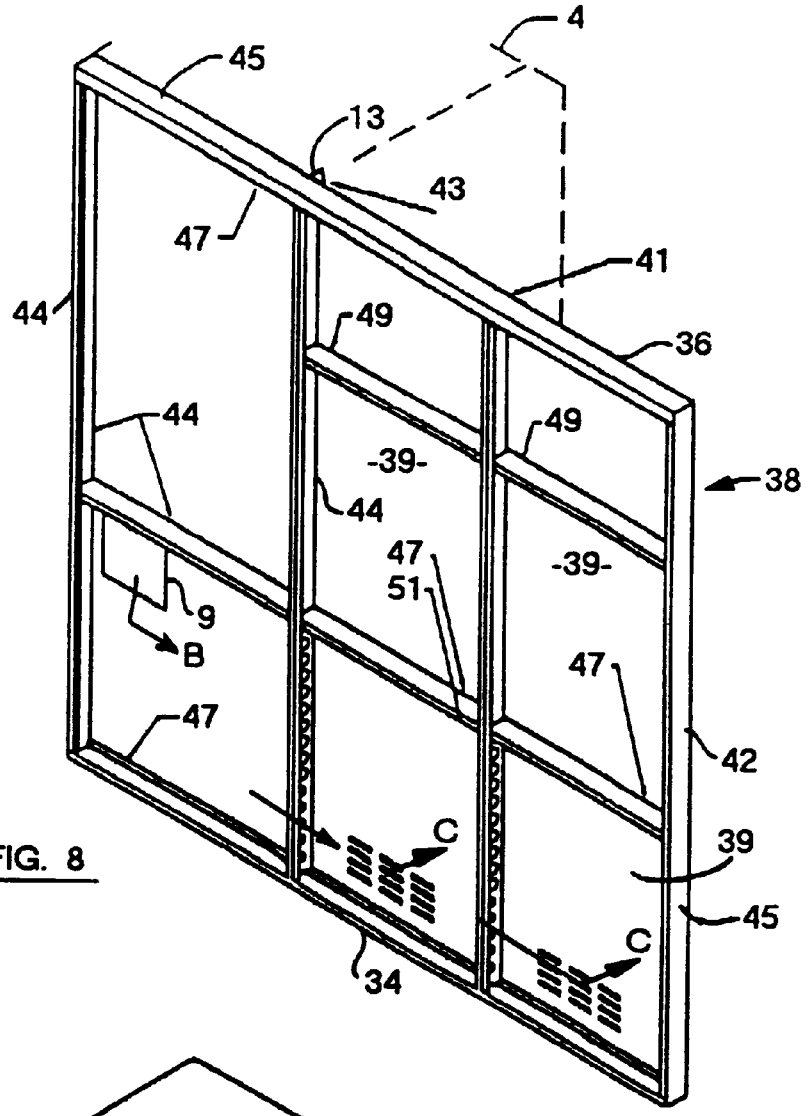
FIG. 8 is a partial view of the air wall.
Figure 9:
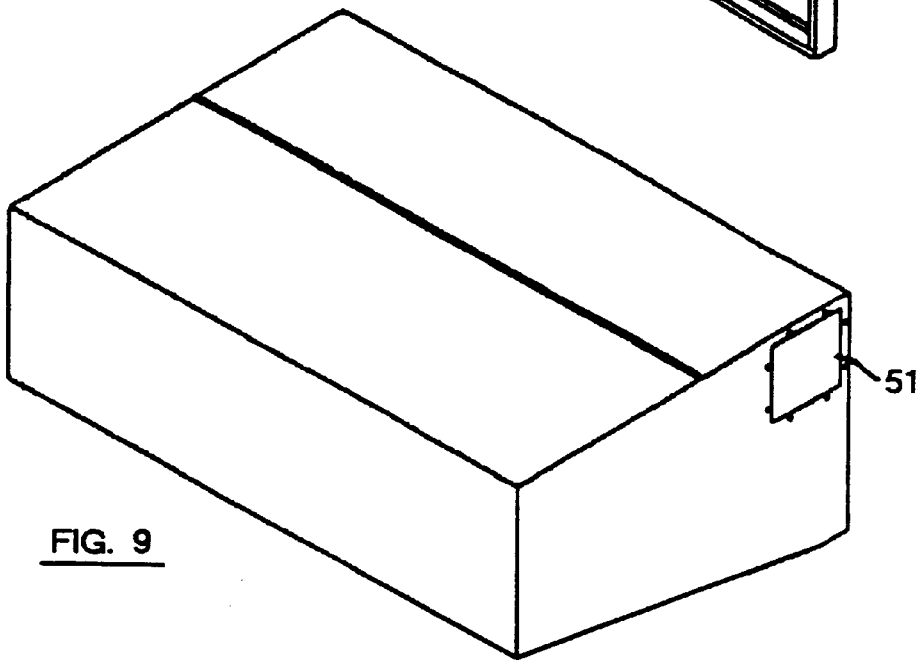
FIG. 9 is a perspective view of the hood.
Figure 11:
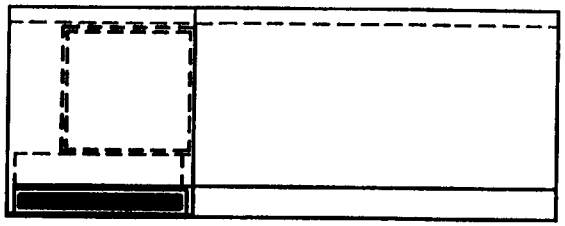
FIG. 11 is a top plan view of FIG. 10.
Figure 12:
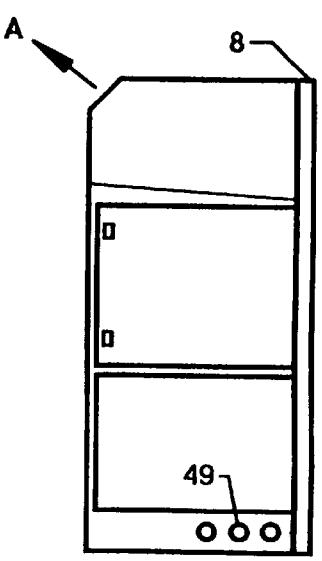
FIG. 12 is a right-hand side elevational view of FIG. 10.

Alternatively, a portion of the filtered exhaust air may be exhausted into the atmosphere as shown by arrow A, and a portion of the filtered exhaust air recirculated through the air wall enclosure 8, as shown by arrow B on FIG. 8. In particular, the exhaust unit includes an opening 9 in an internal wall 11 which communicates with a wall 13 having a plurality of air holes 15 for communication with the air wall enclosure or means.

The air wall means or enclosure 8 is shown in FIGS. 1–4 and FIG. 8 and is defined by bottom wall 34, top wall 36, front wall 38 and back wall 40, left upstanding side wall 42 and right upstanding side wall 44. In the configuration shown in FIGS. 1–4, the right upstanding side wall 44 of air wall 6 contacts the housing 4; in particular, right upstanding side wall 44 of air wall 6 contacts wall 13. The front wall 38 is comprised of panels 39 which are bolted together at 41. The front wall 38 is also bolted to the exhaust unit 4 at 43. A stud frame 45 is provided to rigidify the air wall and exhaust unit assembly. The stud frame 45 is connected to the walls 34, 36, 38, 40 and 42 by any number of means, including welding, fastening or the like. For example, stud welds may be provided at 47 while one may plug weld the top braces 49 while using a foam type gasket at 51.

The walls 34, 36, 38, 40, 42 and 44 define the air wall enclosure 6 which provides a chamber 39 to receive the portion of recirculated filtered exhaust air B.

The air wall enclosure 6 also includes an enclosure air outlet 48 which permits a portion of the filtered recirculated exhaust fumes that are directed through the air wall 6 to be directed downwardly as shown by arrow C. A portion of such air C is then drawn upwardly as shown by arrows D and E back up into the hood 6 and recirculated back through the housing as discussed above. Furthermore, the remainder of the air which passes through the air wall 6 is directed upwardly through the air wall enclosure 6 back up into the housing 4 for further recirculation.

The cooking apparatus which will comprise of electrical cooking equipment (not shown) is located under the hood 6 against the air wall enclosure 8. Accordingly, as the filtered recirculated air flows through the air wall 8, the air tends to cool the walls 38 and 40 of the air wall enclosure. Moreover, the air flow C which is discharged from outlets 48, also tends to carry away heat from the cooking apparatus (not shown) as such air is directed upwardly as shown by D and E back into the exhaust unit 2.

Figure 4:
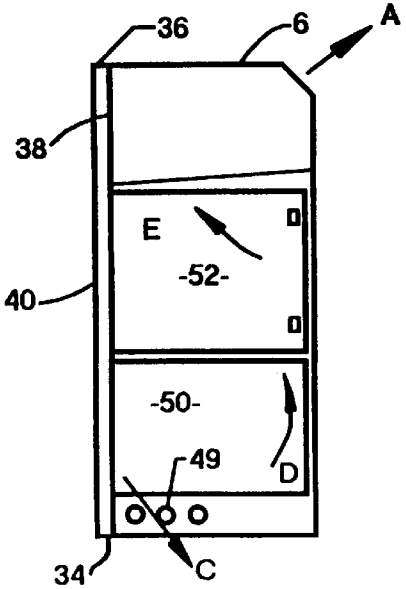
FIG. 4 is a left-hand side elevational view of FIG. 1.

The air wall enclosure 8 assists in supporting the hood 6 as the hood 6 is connected to the air wall enclosure 8 as well as the side of the housing 4 as best shown in FIGS. 1 and 4. The hood is of conventional structure and includes stainless steel grill filters 46 as well as safety spraying equipment to be described herein which are activated in the event of excessive heat or fire.

The hood 6 tends to capture or direct the exhaust fumes up into the hood through opening 51 which exhaust fumes are then directed through the air inlet 10, down into the passage 32 through the filters 12 in a single pass by means of the negative pressure created by the blower 14.

The exhaust unit 4 includes aperture outlet 49 which comprises electrical outlets so as to provide heating power to the cooking equipment. Moreover, the housing 4 includes hinged stainless steel cabinet doors or panels 50 and 52. The panel 50 permits access to the blower 14 and motor 16, while panel 52 permits access to the filters 12. The filters 12 may comprise a variety of conventional filters such as, for example, a three stage filter arrangement whereby each successive filter removes the desired particles out of the exhaust air. More particularly the filter means may comprise a pre-filter 61, mid-filter 62, and high efficiency-filter 63. An optional charcoal filter 65 may be used. The filters may be replaced as required.

The housing 4 may also include fire dampers 67 which are activated by detection of excessive heat in a manner well known to those persons skilled in the art.

Moreover, the housing 4 may also include an ecology spray section 54. The ecology spray section 54 includes odour control means whereby appropriate sprays may be released into the passage 32 so as to control the odour of the air filtered through the unit 2. The ecology spray section 54 includes a cabinet door or panel 56 to permit access into the unit 54. The unit also includes a fire protection cabinet or panel 58 and related fire protection system.

The housing 4 may be designed to have a variety of capacities and specifications and in one particular embodiment, the air capacity was designed to handle 1,000 cubic feet per minute, and the motor 16 comprised of a 1.5 horse power motor having a rating of 1750 rpm.

The housing 4 also includes the appropriate electrical space 60 and the power supply may be designed for a variety of capacities and in one example comprised of 208/3/60 maximum connected load of 175 amps. The filter type of filters 12 will usually comprise of high efficiency particulate filters.

The exhaust unit 2 shown in FIGS. 1 and 4 may be designed to handle two appliances and comprises of receptacles 48 rated at 208/3/30 maximum 49 amps 16 kilowatt power capacity. Accordingly, the exhaust unit shown in FIGS. 1–4 is shipped in a knocked-down form with three separate packages, namely, the pod or housing 4, air wall enclosures 8 and hood 6. The hood 6 may, in some instances, comprise of an existing standard hood and accordingly only two packages, namely the housing 4 and air wall 8 need to be transported. The components are shipped in a variety of sizes, namely 5, 6, and 8 foot sizes (ie. such size refers to the width of the hood or air curtain—5 foot refers generally to a 5 foot width between walls 42 and 44), although any size can be utilized. Such components are designed to be knocked down and to be carried through three foot door openings and up elevators.

In the configuration shown in FIGS. 1–4 the pod or exhaust unit 4 has been selected to be connected whereby the hood 6 is connected to the left side of the housing 4.

In the arrangement shown in FIGS. 10–13 inclusive, the housing 4 is selected to be connected to the exhaust hood on the left side of the hood.

Moreover, FIGS. 14–17, inclusive, illustrate another embodiment of the invention, whereby the housing is selected to be connected to the exhaust hood by means of the back wall of the housing 4. Indeed, the housing could be selected to be connected to the exhaust hood by means of the top wall of the housing 4.

Figure 19:
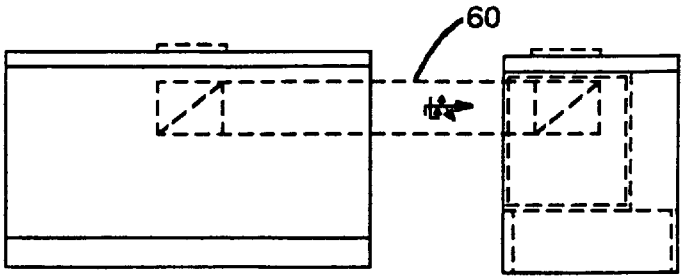
FIG. 19 is a top plan view of FIG. 18.
Figure 20:
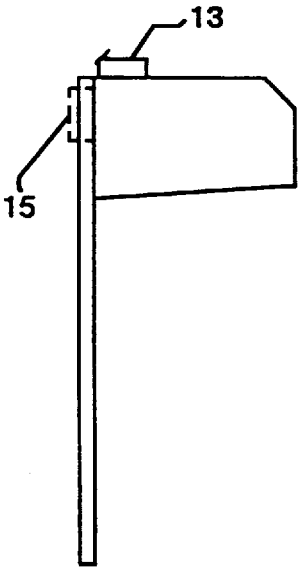
FIG. 20 is a left-hand side elevational view of FIG. 18.

FIGS. 18–20 inclusive illustrate a further embodiment of the invention whereby the pod or exhaust unit 4 is remotely connected to the hood 6 and air wall enclosure 8 by means of an air duct 60. An optional bottom return air duct 62 may be provided. Moreover, in the configuration as shown in FIGS. 18–20, the air wall is optional as is the air discharge 48. The ducts 60 can be connected to ports 13 or optional ports 15.

Accordingly, the invention disclosed herein illustrates a versatile exhaust unit system which is easily transported, versatile in construction, and adaptable to a variety of locations by means of the plurality of configurations which permit the housing to be selectively connected to the exhaust hood in a plurality of configurations. In the embodiment shown, the housing 4 can be connected to the exhaust hood in five configurations, namely left-hand, right-hand, rear, top and remote locations.

The exhaust unit may be designed to have a variety of capacities and specifications and the following examples illustrate just some of these, namely:

EXAMPLE OF SPECIFICATIONS

Air Flow Capacities for

1) Left Hand, Right Hand or Rear Mount

| Size/feet | Cubic Feet/minute |
|---|---|
| 5 | 1100 |
| 6 | 1500 |
| 8 | 2000 |

2) Remote Mount arrangement

| Size/feet | Cubic Feet/minute |
|---|---|
| 5 | 1250–1800 |
| 6 | 1500–1950 |
| 8 | 2000–2250 |

Electrical Load

1) Left hand, Right Hand or Rear Mount

| Size/Ft | Max. No. Appliances | Kilowatts | Amps | Blower H.P. | Main Blower Motor Amps | Main Disconnect | Main Circuit Amps |
|---|---|---|---|---|---|---|---|
| 5 | 2 | 2 × 12 | 2 × 35 | 2 | 6.5 | 100A | 79 |
| 6 | 3 | 3 × 12 | 3 × 35 | 2 | 6.5 | 175A | 114 |
| 8 | 4 | 4 × 12 | 4 × 35 | 2 | 6.5 | 175A | 149 |

2) Remote Mount Arrangement

| Size/Ft | Max. No. Appliances | Kilowatts | Amps | Blower H.P. | Main Blower Motor Amps | Main Disconnect | Main Circuit Amps |
|---|---|---|---|---|---|---|---|
| 5 | 2 | 2 × 12 | 2 × 35 | 3 | 9.5 | 100A | 82 |
| 6 | 3 | 3 × 12 | 3 × 35 | 3 | 9.5 | 175A | 117 |
| 8 | 4 | 4 × 12 | 4 × 35 | 5 | 9.5 | 175A | 152 |

Accordingly, from the above examples:

in one arrangement a 5 foot unit (a) can accommodate a maximum of two cooking appliances (b) with a combined width of the cooking equipment below 48 inches;

in another arrangement a 6 foot unit (a) can accommodate a maximum of three cooking appliances (b) with a combined width of the cooking equipment below 60 inches;

in another arrangement an 8 foot unit (a) can accommodate a maximum of four cooking appliances (b) with a combined width of the cooking equipment below 84 inches.

The types of cooking equipment that can be utilized include hot tops, griddles, broilers, ovens, ranges, steamers, kettles and other specialty cooking equipment.

Moreover, the invention described herein utilizes a fire protection design which incorporates total flood control rather than spot flooding regardless of the type or number of appliances utilized as described above. In other words, the exhaust unit 4 and in particular the exhaust unit assembly 2 includes a fire protection system which showers the appliance surface.

Figure 21:
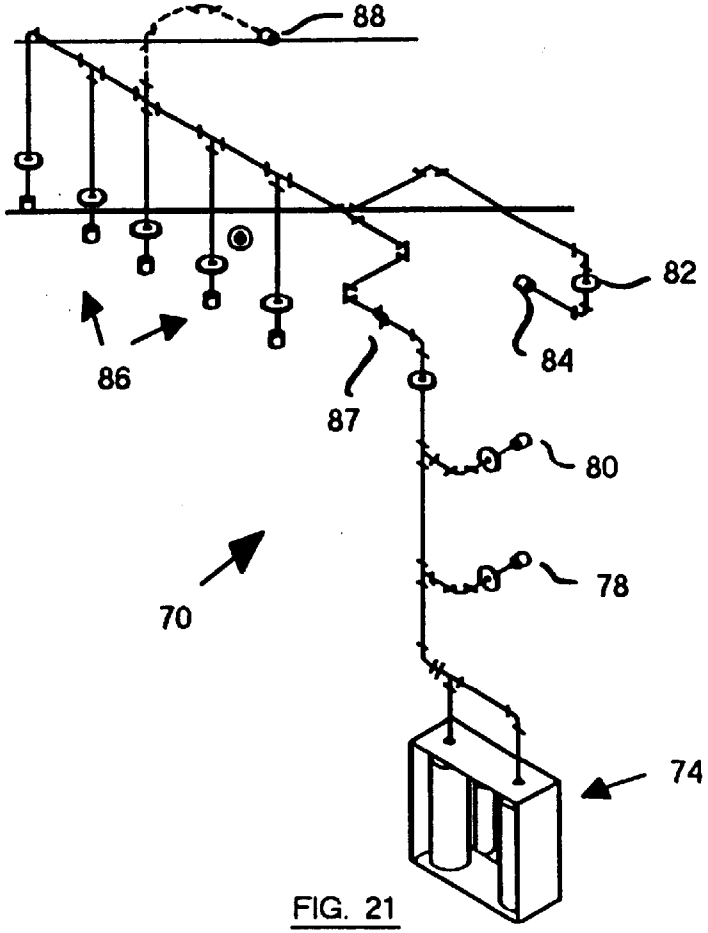
FIG. 21 is a schematic view of the fire protection system.

FIG. 21 illustrates the nozzles 72 of the fire protection system 70 which are associated with the hood 6. In particular the fire protection system 70 includes a supply of fire retardant liquid or chemical in containers 74 located behind panel 56 of exhaust unit 4. The containers are connected to the nozzles by means of a conduit 76.

The fire protection system 70 includes a nozzle 78 located near the bottom of the filter means 12, and a nozzle 80 located near the top of the filter means 12. Numeral 112 represents a quick seal at the penetration point.

Moreover, a nozzle 84 is located in the hood 6 just outside the unit 4, and identified as a plenum protection nozzle.

A plurality of swivel type nozzles 86 are utilized in the hood 6 so as to protect the appliances (not shown) in the event of a fire hazard. A field joint 88 is also utilized. Any number of appliance protection nozzles 86 may be utilized depending on the size of the hood and number of appliances as referred to above, provided that in the event of a fire hazard the nozzles provide a total flood on the top surface of the appliance to eliminate such hazard.

The swivel type nozzles 86 are to be directed to the center of the equipment. In the event that a remote mount arrangement is used as shown in FIG. 21, a duct protection nozzle 88 is provided.

Figure 22:
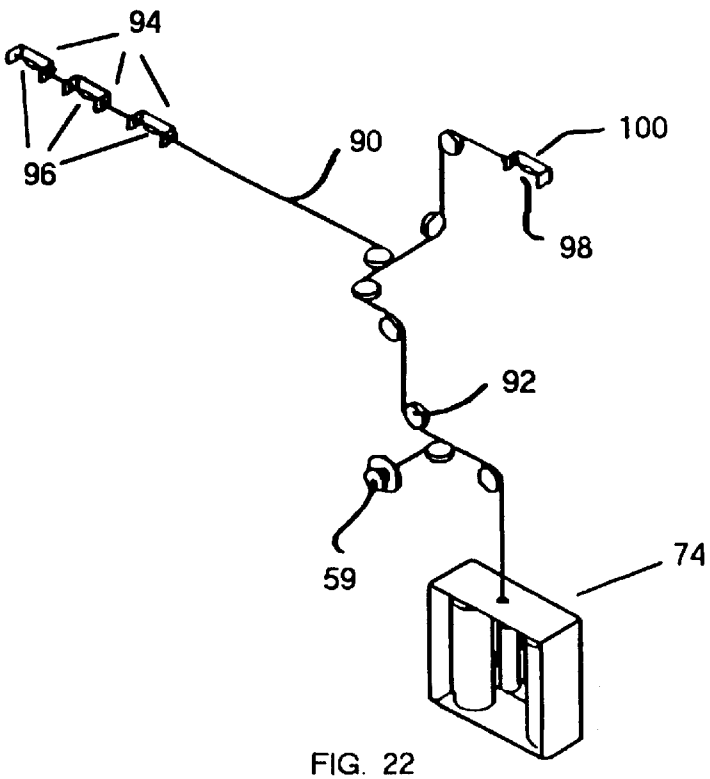
FIG. 22 illustrates the mechanism to activate the fire protection system.

FIG. 22 illustrates the mechanism to activate the fire protection system. A fire protection pull station 59 is provided whereby the system may be activated by pulling pull station 59. A control cable 90 in a conduit is utilized. Lower pulleys 92 and control cable brackets 94 are also illustrated.

A plurality of fusible links 96 are used depending on the size of hood 6 and number of appliances utilized. The fusible links 96 in one embodiment are activated when the temperature reaches 165° C. A further link 98 and control cable bracket 100 are located in passage 32 and provide plenum protection.

Accordingly, in the event that the pull station 59 is manually activated, or any of the fusible links detect heat in excess of 165° C., then control cable 90 is released and fire retardant or liquids are released over the full top surface of the appliance to control and smother the fire.

The means for flooding the cooking equipment may be of fixed design regardless of particular cooking equipment type and location.

Figure 23:
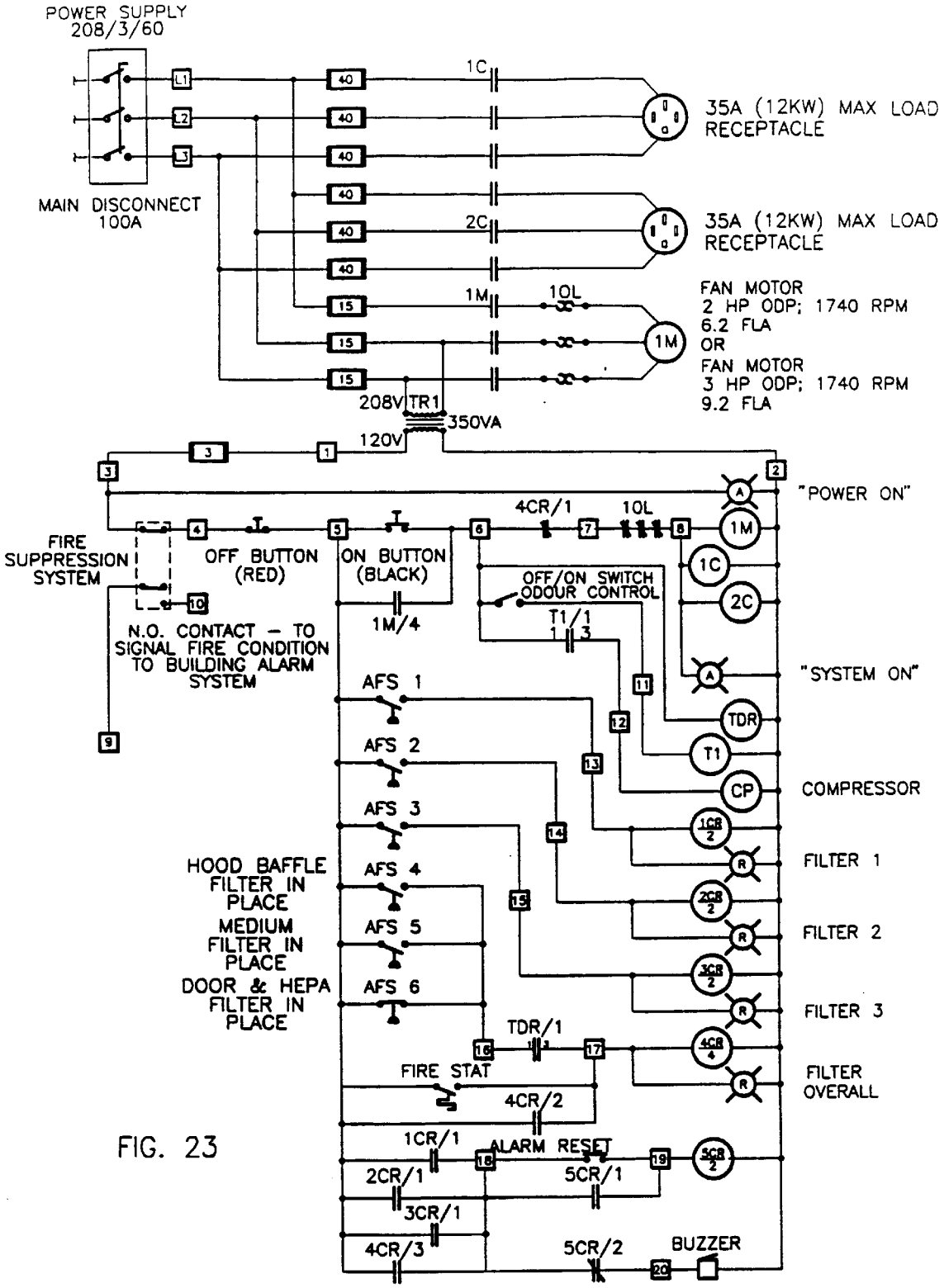
FIG. 23 is a wiring diagram.

FIG. 23 is a representative wiring diagram for a 5 foot size of hood.

Figure 25:
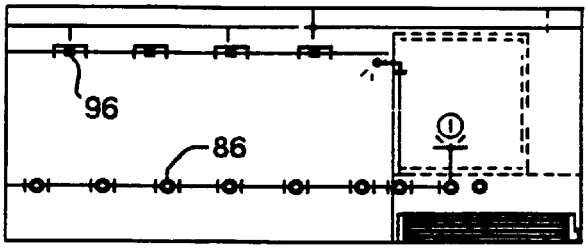
FIG. 25 is a top view of the fire protection system.
Figure 26:
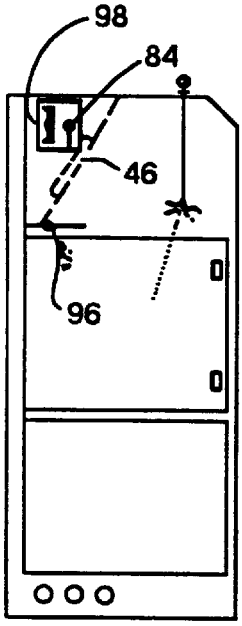
FIG. 26 is a side view of the fire protection system.
Figure 24:
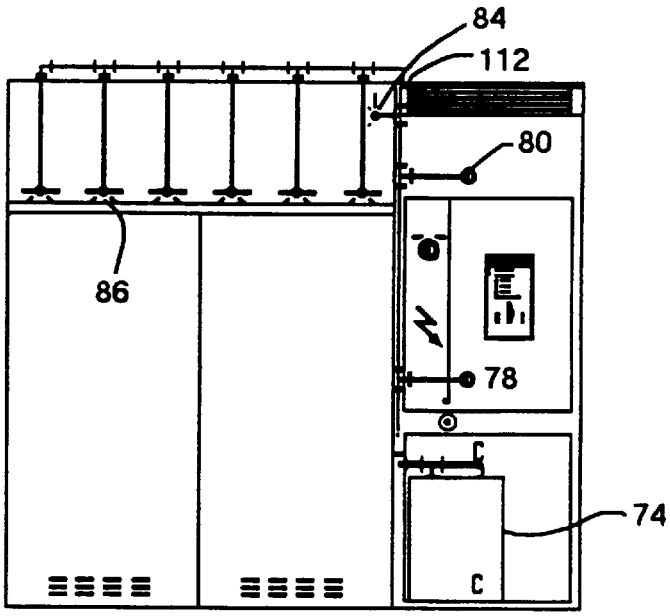
FIG. 24 is a front view of the fire protection system.

FIGS. 24, 25 and 26 further illustrate the fire protection system 70.

The exhaust unit 2 also provides for full recirculation of exhaust air into the environment by means of the air outlet 18 as well as 48. Moreover, the exhaust unit 2 may also provide partial recirculation of air whereby a portion of the air B is introduced to the air wall enclosure 8 and back into the unit 4.

Moreover, the unit 2 also has full exterior exhaust capabilities by connecting the air discharge 22 to the appropriate air duct system.

The fan or blower is belt driven as such design offers more system flexibility. The fan wheel is an airfoil non-overloading type.

The exhaust unit described herein can be broken down into partial packages and hooked up together, or hooked up to other existing equipment, namely standard overhead exhaust hoods. However, the core of the exhaust unit consists of the filtration pod or housing 4 which includes safety interlocks. The housing 4 adapts to other hoods and fire protection systems.

In one embodiment of the invention as described above, duct work and large blowers are unnecessary. The exhaust unit 4 is self-contained as it includes a fire protection system, filter, fan, all electrical controls and power. The unit 4 also supplies air to the environment at the back, top or through a duct. Although a vertically oriented unit 4 is shown, such unit 4 may be mounted horizontally or in a ceiling.

The unit 4 is also beneficial in that if an exhausting hood does not meet code specifications, such hood could meet code specifications (for example in some areas air containing grease may not be directly released into the atmosphere) by utilizing the unit 4 described herein, since the filter means 12 would filter such grease.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. An exhaust unit assembly of modular construction comprising:

(a) an exhaust hood being adapted to be positioned over top of cooking equipment; and (b) an exhaust unit having spaced top, bottom, front, back, and first and second side walls all interconnected and defining a generally rectangular housing, such housing having:

(i) a passage therethrough with an air inlet and an air outlet communicating with said passage;

(ii) removable filter means disposed within such passage for filtering said air;

(iii) blower means associated with said passage for drawing said air through said air inlet and said passage, and discharging filtered air our said air outlet;

said exhaust unit being adapted to be selectively connectable to said exhaust hood so that said exhaust unit is positioned either directly behind, directly to either side of, or by duct means remote from, said exhaust hood, where a portion of said filtered air is discharged into the atmosphere, and a portion is recirculated through a vertically upstanding air wall means connected to said exhaust hood and selectively connected to the exhaust unit in one of said configurations.

2. An exhaust unit assembly as claimed in claim 1, further including odour control means associated with said passage for controlling the odour of air filtered through said filter means.

3. An exhaust unit assembly as claimed in claim 1, wherein filtered air is discharged from the exhaust unit assembly into the atmosphere immediately surrounding the exhaust unit assembly.

4. An exhaust unit assembly as claimed in claim 1, wherein filtered air is discharged into a duct system for transport to the exterior of the building.

5. An exhaust unit assembly as claimed in claim 1 including fire protection means for flooding said cooking equipment in a fixed design regardless of cooking equipment type and location.

6. An exhaust unit assembly as claimed in claim 1, wherein said assembly is modular for disassembly and transportation as components.

7. An exhaust unit assembly as claimed in claim 1, wherein said exhaust unit is adapted for connection to any standard exhaust hood.

8. An exhaust unit assembly as claimed in claim 1, wherein a plurality of exhaust hoods is connected to the exhaust unit by means of ducts.

9. An exhaust unit assembly as claimed in claim 1, where said air wall means includes a lower enclosure outlet for discharging a portion of said filtered air and an upper enclosure outlet for communication with said inlet of said housing.

10. An exhaust unit assembly of modular construction comprising:

(a) an exhaust unit having:

(i) spaced top, bottom, front, back, and first and second side walls all interconnected and defining a generally rectangular housing;

(ii) said housing having a passage therethrough with selectively openable air inlets in the left and right side walls and top and back walls all communicating when open with said passage;

(iii) an air outlet communicating with said passage;

(iv) removable filter means within such passage for filtering air flowing therethrough; and (v) blower means for drawing said air through said air inlet and said filter means and discharging filtered air out said air outlet;

(b) an exhaust hood:

(i) having spaced top, front, back and two side walls defining an enclosure open at the bottom for receiving fumes from cooking equipment;

(ii) being adapted to be positioned over top of cooking equipment; and (iii) having selectively openable exhaust apertures in each of the two sides, and the top and back walls of said enclosures;

(c) said exhaust unit and said exhaust hood being adapted to be selectively positioned relative to each other in any of four possible configurations:

(i) said exhaust hood directly adjacent to and connected to first side wall of exhaust unit;

(ii) said exhaust hood directly adjacent to and connected to second side wall of exhaust unit;

(iii) said exhaust hood directly behind and connected to back wall of exhaust unit; or (iv) said exhaust hood positioned remotely from and connected to exhaust unit by duct means.

11. An exhaust unit assembly as claimed in claim 10, further including odour control means associated with said passage for controlling the odour of air filtered through said filter means.

12. An exhaust unit assembly as claimed in claim 10, wherein filtered air is discharged from the exhaust unit assembly into the atmosphere immediately surrounding the exhaust unit assembly.

13. An exhaust unit assembly as claimed in claim 10, wherein filtered air is discharged into a duct system for transport to the exterior of the building.

14. An exhaust unit assembly as claimed in claim 10 including fire protection means for flooding said cooking equipment in a fixed design regardless of cooking equipment type and location.

15. An exhaust unit assembly as claimed in claim 10, wherein said assembly is modular for disassembly and transportation as components.

16. An exhaust unit assembly as claimed in claim 10, wherein said exhaust unit is adapted for connection to any standard exhaust hood.

17. An exhaust unit assembly as claimed in claim 10, wherein a plurality of exhaust hoods is connected to the exhaust unit by means of ducts.

18. An exhaust unit assembly as claimed in claim 10, where a portion of said filtered air is discharged into the atmosphere, and a portion is recirculated through a vertically upstanding air wall means connected to said exhaust hood and selectively connected to the exhaust unit in one of said configurations.

19. An exhaust unit assembly as claimed in claim 18, where said air wall means includes a lower enclosure outlet for discharging a portion of said filtered air and an upper enclosure outlet for communication with said inlet of said housing.

* * * * *